US008952577B2

(12) United States Patent
Bostjan

(10) Patent No.: US 8,952,577 B2
(45) Date of Patent: Feb. 10, 2015

(54) SAFETY CONTROL SYSTEM FOR AN ELECTROMAGNETIC DOOR LOCK OF AN ELECTRIC HOUSEHOLD APPLIANCE

(75) Inventor: Berginc Bostjan, Srpenica (SI)

(73) Assignee: Illinois Tool Works Inc., Glenview, IL (US)

( * ) Notice: Subject to any disclaimer, the term of this patent is extended or adjusted under 35 U.S.C. 154(b) by 810 days.

(21) Appl. No.: 13/132,867

(22) PCT Filed: Dec. 4, 2009

(86) PCT No.: PCT/US2009/066731

§ 371 (c)(1),
(2), (4) Date: Jun. 3, 2011

(87) PCT Pub. No.: WO2010/065828

PCT Pub. Date: Jun. 10, 2010

(65) Prior Publication Data

US 2011/0239711 A1 Oct. 6, 2011

(30) Foreign Application Priority Data

Dec. 5, 2008 (IT) ..... TO2008A0905

(51) Int. Cl.

| | |
|---|---|
| ***H02H 11/00*** | (2006.01) |
| ***D06F 37/42*** | (2006.01) |
| ***A47L 15/42*** | (2006.01) |
| ***D06F 39/14*** | (2006.01) |

(52) U.S. Cl.

CPC ..... *D06F 37/42* (2013.01); *A47L 15/4259* (2013.01); *D06F 39/14* (2013.01)

USPC ..... 307/326

(58) Field of Classification Search

USPC ..... 307/326

See application file for complete search history.

(56) References Cited

U.S. PATENT DOCUMENTS

| | | | |
|---|---|---|---|
| 3,638,457 | A | 2/1972 | Filipak |
| 5,050,407 | A | 9/1991 | Wild |

(Continued)

FOREIGN PATENT DOCUMENTS

| | | | |
|---|---|---|---|
| EP | 1988207 | A2 | 11/2008 |

OTHER PUBLICATIONS

Italian Search Report for IT Application No. TO2008000905 dated Nov. 2, 2009.

(Continued)

*Primary Examiner* — Jared Fureman
*Assistant Examiner* — Duc M Pham
(74) *Attorney, Agent, or Firm* — Lowe Hauptman & Ham LLP

(57) ABSTRACT

A safety control system for an electromagnetic door lock of an electric household appliance, wherein a blocking pawl is controlled by the movement of a core of an electromagnet, including a supplying circuit of a coil of the electromagnet, power supplying means to supply electric pulses in the circuit for energizing the coil and a PTC element arranged in series in the circuit; wherein power supplying means are of the type adapted to generate first pulses for taking the pawl to a blocking position and second pulses, having a polarity opposite to the first, for taking the pawl to a releasing position; and including means for determining, according to the parameters of an operating cycle of the electric household appliance, the emission of at least one train of first pulses by the power supplying means, so as to produce the heating of the PTC element.

21 Claims, 1 Drawing Sheet

(56) References Cited

U.S. PATENT DOCUMENTS

| | | | | |
|---|---|---|---|---|
| 5,323,628 | A * | 6/1994 | Mori et al. | 68/12.26 |
| 5,823,017 | A * | 10/1998 | Hapke et al. | 68/12.26 |
| 6,334,637 | B1 | 1/2002 | Chioffi | |
| 2008/0256999 | A1 * | 10/2008 | Hapke et al. | 70/283 |
| 2010/0181783 | A1 * | 7/2010 | Lavrencic | 292/341.16 |

OTHER PUBLICATIONS

ISR for PCT/US2009/066731 dated Jan. 29, 2010.

* cited by examiner

SAFETY CONTROL SYSTEM FOR AN ELECTROMAGNETIC DOOR LOCK OF AN ELECTRIC HOUSEHOLD APPLIANCE

RELATED APPLICATIONS

The present application is national phase of PCT/US2009/066731 filed Dec. 4, 2009, and claims priority from Italian Application Number TO2008A000905 filed Dec. 5, 2008.

TECHNICAL FIELD

The present invention relates to a safety control system for an electromagnetic door lock of an electric household appliance, in particular a washing machine and/or drying machine provided with a rotating drum, or even a dishwasher, as well as to a safety control method for the mentioned door lock.

BACKGROUND ART

It is known that the doors of electric household appliances in which a washing cycle is carried out, in particular those of washing machines/drying machines/dishwashers, are blocked in use in a closed position by a blocking device provided with a safety device which is released only either at the end of the washing cycle or in all cases when the rotating drum of the electric household appliance is either still or turns at a speed which is not dangerous for the user.

The safety devices known from U.S. Pat. No. 6,334,637, for example, include a blocking pawl and a control system for selectively moving the pawl between an extracted position and a retracted position in a through seat of a casing carrying the control system and the pawl itself therein, so that one end of the pawl protruding in the extracted position from the seat, can cooperate in use with a plate of the blocking device of the door, slidingly carried by a support on which the casing of the safety device is snappingly fixable; the support is in turn fixable in use to a carcass of the electric household appliance, by the side of the door to be blocked and so that the sliding plate is adapted to cooperate in turn, in use, with a striker of the door.

The control system includes in turn a first electric actuator device, e.g. a bimetal foil associated with a PTC element (tablet), or thermistor, which when the electric household appliance is running, is adapted to displace the pawl between the extracted and retracted positions, and electromagnetic means for blocking the pawl in the extracted position, in which position it engages a perforation of the sliding plate, thus blocking its transversal sliding on the support and therefore preventing the same from being released from the striker even if the user attempts to force the door into the opening position.

The electromagnetic blocking means include in turn an electromagnetic actuator of the linear type which is actuated in use by a series of single electric pulses upon which the core of the electromagnet rotationally actuates, by means of a ratchet, a gear wheel associated with cam means which selectively block/release the pawl in the extracted position, thus cooperating with a side appendix thereof. Thereby, by means of an appropriate shape of the cam means and the gear wheel associated therewith, the pawl and then the whole blocking device may be blocked, by applying a single electric pulse to the electromagnetic actuator, while two consecutive electric pulses are needed to release them.

The known device described above is complex and costly, as well as large in size.

DISCLOSURE OF INVENTION

It is an object of the present invention to provide a simple, cost-effective and small-sized control system which is however safe; in particular, considering that the control pulses of the electromagnet are generally produced by a TRIAC, it is an object to provide a control system which is able to neutralize possible malfunctions of the TRIAC with a consequent undesired pulse emissions. It is a further object of the invention to provide a safety control method for an electromagnetic door lock which may use a highly simplified mechanical device, and which allows to obtain a nearly immediate releasing of the door at the end of the operating cycle of the electric household appliance, so as to eliminate the dead times due to the time needed for the thermistor to cool down.

The present invention thus relates to a safety control system for an electromagnetic door lock of an electric household appliance as defined in claim 1, as well as to a control method as defined in claim 7.

In particular, where the door lock comprises a blocking pawl controlled by the movement of an electromagnet core, the control system of the invention comprises a circuit for supplying power to a coil of the electromagnet, power supplying means to supply electric pulses in the circuit for energizing the coil and a PTC element arranged in series in the circuit.

According to one aspect of the invention, the power supplying means are of the type adapted to generate first pulses for taking the pawl to a blocking position, and second pulses having a polarity opposite to the first, for taking the pawl to a releasing position; the control system comprising, in combination with such a feature, means for determining, according to the parameters of an operating cycle of the electric household appliance, the selective emission of at least one train of first pulses by the power supplying means, so as to produce the heating of the PTC element.

The power supplying means consist in at least one TRIAC arranged in series in the circuit, and the means for determining the selective emission of a train of first pulses by the power supplying means consist in a microprocessor.

Thereby, a method of controlling the door lock may be provided, comprising the steps of:

- generating at least one first pulse at the beginning of an operating cycle of the electric household appliance;
- generating at least one train of first pulses so as to produce the heating of the PTC element, either after a first predetermined time, or according to appropriately detected operating parameters of the operating cycle of the electric household appliance;
- terminating the generation of said train of first pulses, either after a second predetermined time, or according to a variation of the appropriately detected operating parameters of the operating cycle of the electric household appliance; and
- after a third predetermined time, enough to allow the PTC element to cool down, generating the emission of at least one second pulse.

An extremely simple, cost-effective and especially small-sized control system is thus obtained, in which the mechanical part is limited to the pawl and the core of the electromagnet, which may be directly connected to each other, if the (blocking or releasing) stroke end positions of the pawl are determined, for example, by permanent magnets (such as in the co-pending Slovene patent application n. P 200800206 to the same Applicant) and in which possible pulses emitted by the TRIAC during the step of blocking (e.g. second pulses) may not especially produce any accidental release, because the circuit is kept in a substantially non-conducting state by heating the PTC element due to the emission of a train of first pulses, which train does not affect the release because all pulses are directed to take the pawl to the blocking position.

Furthermore, blocking and releasing the door may be easily achieved several times during the operating cycle of the electric household appliance, e.g. according to the speed of the drum in case of a washing machine or drying machine, thus allowing the user to open the door during the washing cycle for checking or adding previously forgotten garments or washing additives. Furthermore, at the end of the operating cycle, a nearly instantaneous release of the door is obtained, considering that the emission of the pulse train terminates while the drum is still running (although at slow speed), thus giving time to the PCT element to cool down before fully stopping the drum itself.

BRIEF DESCRIPTION OF THE DRAWINGS

Further features and advantages of the present invention will be apparent from the following description of a preferred embodiment, exclusively provided by way of non-limitative example, with reference to the figures of the accompanying drawing, in which.

BEST MODE FOR CARRYING OUT THE INVENTION

Figure 1:
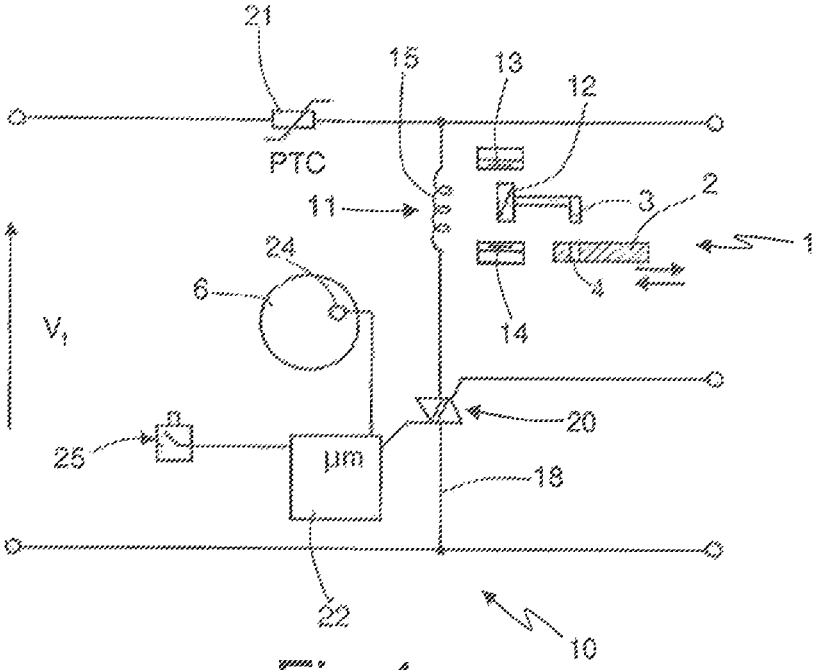
FIG. 1 diagrammatically shows an electromagnetic door lock and the control system according to the invention applied thereto.

With reference to FIG. 1, numeral 1 indicates as a whole an electromagnetic door lock comprising a slide 2 adapted to cooperate with the notch of the door to be released (not shown) in a known manner, and a sliding pawl 3 of known type and adapted to selectively assume a blocking position, in which it engages a perforation 4 of slide 2, and a releasing position in which it does not engage the perforation 4, thus leaving slide 2 free to slide in the direction of the arrows.

The door lock 1 is intended to equip an electric household appliance, e.g. a washing machine and/or drying machine and/or dishwasher, not shown, provided with a rotating drum 6, for example, and is controlled by a safety control system, indicated by numeral 10 as a whole.

According to the invention, the safety control system 10 for the door lock 1 comprises an electromagnet 11, its core 12 controlling the position of the pawl 3, e.g. by being directly connected to the core 12.

In the illustrated non-limiting example, the ferromagnetic core 12 faces a pair of permanent magnets 13 and 14 which, due to magnetic attraction on the core 12, define two stable stroke end positions thereof, corresponding to the releasing and blocking positions of pawl 3, respectively; core 12 is further operatively coupled to a coil 15 of the electromagnet 11, dimensioned so as to overcome, when energized, the attraction exerted by the magnets 13 and 14 and to be able to consequently move, as explained below, the core 12 between the two stroke end positions defined by the magnets 13 and 14, which positions are stable because when the coil 15 is not energized, the attraction of the magnets 13 and 14 is sufficient to stably keep the core 12 blocked against the magnet 13 or 14 which is adjacent thereto in that moment.

In addition to the electromagnet 11, the control system 10 comprises a supplying circuit 18 to supply power to the coil 15 which is electrically arranged in series in the circuit 18, power supplying means 20 to supply electric voltage pulses (FIG. 2) in the circuit 18 for energizing the coil 15 and a PTC element (tablet) 21, or thermistor, also electrically arranged in series in the circuit 18 or in all cases in a manner adapted to substantially interrupt in use the circuit 18, as explained below, so as to prevent the electric pulses generated by the power supplying means 20 from reaching coil 15.

In particular, according to one aspect of the invention, the power supplying means 20 are selected so as to be of the type adapted to generate (FIG. 2) first pulses 51, in this case, by virtue of the configuration of the electromagnet 11, adapted to take the pawl to the blocking position, and second pulses 52 having a polarity opposite to the first pulses 51, adapted to take, the pawl 3 to the releasing position; in the case shown, the power supplying means 20 consist in a TRIAC electrically arranged in series in the circuit 18, and the pulses 51 and 52 having an opposite polarity are current pulses over time (I,t in the Cartesian diagram in FIG. 2), of time duration "t", emitted by exploiting the positive semiwave and the negative semiwave of the same alternating electric current, e.g. from a mains, delivered at a potential Vt.

According to a further aspect of the invention, in combination with such a feature, the control system 10 further comprises means 22 for determining, according to operating cycle parameters of the electric household appliance which are either detected each time or stored, the selective emission by the power supplying device 20 of at least a train 53 (FIG. 2) of first pulses 51 so as to produce the heating of the PCT element or thermistor 21 and thus the inhibition of the electromagnet 11 (it is known indeed that while being heated, a PCT element raises its electric resistance to a non-infinite value, but which is however very high so as to actually (i.e. for all practical purposes) interrupt the circuit in which it is inserted).

Means 22 for determining the selective emission of the train 53 of pulses 51 by power supplying means 20 preferably consist in an appropriately programmed microprocessor. In particular, the microprocessor 22 is connected to means 24 for detecting the mentioned parameters of the operating cycle of the electric household appliance; in this case, where the electric household appliance is a washing machine and/or a drying machine, to a sensor 24 of the rotation speed of the drum 6.

According to a further aspect of the invention, the control system 10 further comprises a releasing button 25 controllable by the user and connected to the microprocessor 22 for determining in use the emission of at least one second pulse 52 by the power supplying means 20, before the emission of the first train 53 of first pulses 51.

Finally, it is worth noting that the microprocessor 22 is programmed so that the means represented thereby for determining, according to the parameters of the operating cycle of the electric household appliance, the selective emission by power supply means 20 of the train 53 of pulses 51, are also adapted to determine the termination of the emission of train(s) 53 of first pulses 51 and, successively, the emission of at least one second pulse 52, in response to a predetermined variation of the operating parameters, in particular to a decrease of the speed of drum 6 under a predetermined threshold, e.g. 60. rpm, detected by sensor 24.

Figure 2:
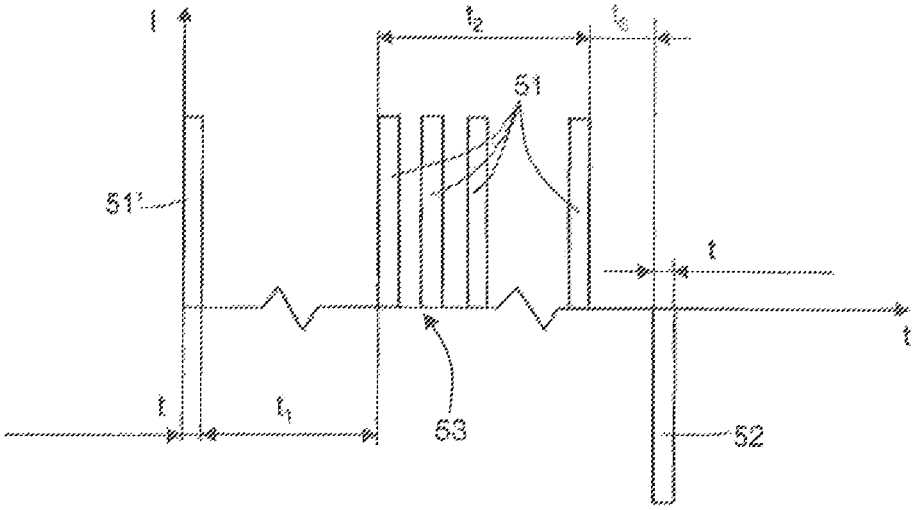
FIG. 2 graphically shows the control method of invention.

According to the above description, it is apparent that the control system 10 according to the invention implements a safety control method for the electromagnetic door lock 1 comprising the steps of (see FIG. 2):

generating at least one first pulse 51' of duration t at the beginning of an operating cycle of the electric household appliance (zero time in the diagram of FIG. 2);

generating at least one train 53 of first pulses 51 so as to produce the heating of the PTC element 21, either after a first predetermined time t1, or according to appropriately detected operating parameters of the operating cycle of the electric household appliance, e.g. the rotation speed of drum 6 detected by sensor 24.

Subsequently, the control method according to the invention comprises the further steps of:

terminating the generation of at least one train 53 of pulses 51 either after a second predetermined time t2, or according to a variation of the appropriately detected operating parameters of the operating cycle of the electric household appliance, i.e. the slowing down of the rotation speed of drum 6 under the threshold of 60 rpm; and after a third predetermined time t3, sufficient to allow the PTC element 21 to cool down, generating the emission of at least one second pulse 52 of duration t.

Finally, the method according to the present invention further comprises the step of detecting a possible releasing request by the user and therefore generating at least one second pulse 52 before generating the train 53 of first pulses 51.

Thereby, when the pulse 51' is emitted, pawl 3 is taken to the blocking position, in order to engage the perforation 4; however, during the entire time t1 (during which the speed of drum 6 is under the threshold of 60 rpm, for example), the user may open the door of the electric household appliance, e.g. by pressing the button 25; in this case, indeed, pressing the button 25 imparts to the microprocessor 22 the order to have the TRIAC 20 emit a pulse 52 which takes the pawl 3 to the releasing position, thus releasing the slide 2, and so the user may open the door.

After the time t1 has elapsed, i.e. when the threshold of 60. rpm is exceeded by the drum 6, the microprocessor 22 emits a train of pulses 51, a single train 53 or a plurality of trains 53 spaced over time, and the first pulse 51 returns the pawl 3 to the blocking position; the subsequent pulses 51 of the same train 53 (or subsequent trains 53) do not alter the position of pawl 3 but produce a current passage in the circuit 18 sufficient to heat up the thermistor 21; once the threshold temperature has been reached, this substantially works as a switch, thus "opening" the circuit 18 and preventing the current from passing towards the coil 15, which will be sufficient to energize the same, and therefore inhibiting the electromagnet 11 (a minimum current, however insufficient to actuate the electromagnet 11, will indeed pass in the circuit 18 with the thermistor 21 being hot and thus provided with very high resistance).

Under such a condition, the control system 10 keeps the doors lock 1 under safety blocking conditions; indeed, the pawl 3 blocks the slide 2, which blocks the door of the electric household appliance; even if an external cause produces a malfunction of the TRIAC 20, e.g. the accidental emission of a pulse 52, this may not take the pawl 3 to the releasing position, because the circuit 18 does not allow a sufficient current passage to energize the coil 15 by the action of thermistor 21.

At the end of the operating cycle, e.g. at the end of the washing cycle, the speed of the drum 6 returns under the threshold of 60 rpm and then the microprocessor 22 instructs the TRIAC 20 to no longer emit the trains 53 of pulses 51; while the speed of drum 6 gradually decreases to zero, thermistor 21 has time enough to cool down, thus "reopening" the circuit 18, i.e. allowing a free passage of the electric current again, without opposing a very high electric resistance thereto; therefore, after time t3, when the microprocessor 22 makes the TRIAC 20 emit a pulse 52, this may reach the coil 15, thus energizing it (the electromagnet 11 is no longer inhibited), and taking the pawl 3 to the releasing position.

The invention claimed is:

1. A safety control system for an electromagnetic door lock of an electric household appliance, wherein a blocking pawl is controlled by the movement of a core of an electromagnet, comprising a supplying circuit of a coil of the electromagnet, power supplying means to supply electric pulses in the circuit for energizing the coil and a PTC element arranged in series in the circuit; characterized in that: the power supplying means are of the type adapted to generate first pulses for taking the pawl to a blocking position and second pulses, having a polarity opposite to the first, for taking the pawl to a releasing position; and in combination, in that it further comprises means for determining, according to the parameters of an operating cycle of the electric household appliance, the selective emission of at least one train of first pulses by the power supplying means, so as to produce the heating of the PTC element.

2. A control system according to claim 1, characterized in that said power supplying means consist in at least one TRIAC arranged in series in the circuit.

3. A control system according to claim 1, characterized in that the means for determining the selective emission of a train of first pulses by the power supplying means consist in a microprocessor.

4. A control system according to claim 3, characterized in that said microprocessor is connected to detecting means for said parameters of an operating cycle of the electric household appliance, and specifically when the electric household appliance is a washing machine and/or drying machine, to a rotation speed sensor of a drum of the electric household appliance.

5. A control system according to claim 3, characterized in that it further comprises a releasing button controllable by the user and connected to said microprocessor for determining the emission of at least one second pulse by said supplying means, before the emission of said train of first pulses.

6. A control system according to claim 1, characterized in that said means for determining the selective emission of a train of first pulses by said power supplying means, according to the parameters of an operating cycle of the electric household appliance, are adapted to determine, in response to a predetermined variation of said operating parameters, the termination of the emission of the train of first pulses and, subsequently, the emission of at least one second pulse.

7. A safety control method for an electromagnetic door lock of an electric household appliance, wherein a blocking pawl is controlled by the movement of a core of an electromagnet, one coil of which is energized by first and second pulses of opposite polarity, generated by power supplying means electrically arranged in series to a PTC element, for selectively taking the pawl to a blocking position and to a releasing position, respectively; characterized in that it comprises the steps of:

generating at least one first pulse at the beginning of an operating cycle of the electric household appliance;

generating at least one train of first pulses so as to produce the heating of the PTC element, either after a first predetermined time, or according to appropriately detected operating parameters of the operating cycle of the electric household appliance.

8. A method according to claim 7, characterized in that it further comprises the steps of:

terminating the generation of such a train of first pulses, either after a second predetermined time, or according to a variation of the appropriately detected operating parameters of the operating cycle of the electric household appliance; and after a third predetermined time, sufficient to allow the cooling of the PTC element, generating the emission of at least one second pulse.

9. A method according to claim 7, characterized in that it further comprises the step of detecting a possible releasing request by the user and consequently generating at least one pulse, before generating said train of first pulses.

10. A system, comprising:

a safety control system for an electromagnetic door lock of an electric household appliance, the system including:

a blocking pawl;

an electromagnet, wherein the system is configured to control the movement of the blocking pawl by activation of the electromagnet;

a circuit configured to provide a path for power to the electromagnet; and a PTC element arranged in series in the circuit, wherein the system is configured to supply electric pulses in the circuit to activate the electromagnet, the system is configured to generate first pulses for taking the pawl to a blocking position and second pulses, having a polarity opposite to the first, for taking the pawl to a releasing position, and wherein the system is configured to determine, according to the parameters of an operating cycle of the electric household appliance, the selective emission of at least one train of first pulses, so as to produce the heating of the PTC element.

11. A system according to claim 10, further comprising a TRIAC arranged in series in the circuit, wherein the TRIAC is configured to supply power.

12. A system according to claim 1, further comprising a microprocessor that is configured to determine the selective emission of the train of first pulses.

13. A device, comprising:

a washing machine or a drying machine corresponding to the electric household appliance including the system according to claim 12, wherein the microprocessor is connected to a rotation speed sensor of a drum of the washing machine or the drying machine.

14. A system according to claim 12, further comprising a releasing button controllable by a user of the household appliance and connected to said microprocessor for determining the emission of at least one second pulse, before the emission of said train of first pulses.

15. A system according to claim 10, wherein the system is adapted to determine, in response to a predetermined variation of said operating parameters, the termination of the emission of the train of first pulses and, subsequently, the emission of at least one second pulse.

16. A system according to claim 10, wherein the electromagnet includes a core and a coil, and wherein the system is configured to control the movement of the blocking pawl by the movement of the core of the electromagnet induced by supply of power to the coil, and wherein the circuit configured to provide a path for power to the coil of the electromagnet.

17. A control system according to claim 1, wherein the PTC element is arranged in the circuit such that it is adapted to substantially interrupt the circuit upon heating of the PCT element so as to prevent the electric pulses supplied by the power supplying means from energizing the coil.

18. A control system according to claim 17, wherein the control system is configured such that the electric pulses supplied by the power supplying means cause the PCT element to heat and interrupt the circuit.

19. A method according to claim 7, characterized in that it further comprises the steps of:

substantially interrupt the circuit upon heating of the PCT element by the train of first pulses so as to prevent the first pulses from reaching the coil, thereby preventing the power supplying means from energizing the coil.

20. A system according to claim 10, wherein the PTC element is arranged in the circuit such that it is adapted to substantially interrupt the circuit upon heating of the PCT element so as to prevent the first pulses from activating the electromagnet.

21. A system according to claim 20, wherein the system is configured such that the heating of the PCT element interrupts the circuit.

* * * * *